US006797873B2

(12) United States Patent
Miyake

(10) Patent No.: US 6,797,873 B2
(45) Date of Patent: Sep. 28, 2004

(54) MUSIC DATA PERFORMANCE SYSTEM AND METHOD, AND STORAGE MEDIUM STORING PROGRAM REALIZING SUCH METHOD

(75) Inventor: Satoshi Miyake, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 197 days.

(21) Appl. No.: 10/032,607

(22) Filed: Dec. 27, 2001

(65) Prior Publication Data

US 2002/0078820 A1 Jun. 27, 2002

(30) Foreign Application Priority Data

Dec. 27, 2000 (JP) ..... 2000-398354

(51) Int. Cl.[7] ..... G10H 1/02; G10H 5/00
(52) U.S. Cl. ..... 84/662; 84/667
(58) Field of Search ..... 84/626, 662, 665, 84/667, 633, 635

(56) References Cited

U.S. PATENT DOCUMENTS 5,898,120 A * 4/1999 Kira ..... 84/638
5,905,223 A * 5/1999 Goldstein ..... 84/649
6,051,771 A * 4/2000 Iizuka ..... 84/622

FOREIGN PATENT DOCUMENTS

JP Hei 05-113789 A 5/1993
JP Hei 08-305360 A 11/1996
JP 2677149 7/1997

* cited by examiner

*Primary Examiner*—Jeffrey W Donels
(74) *Attorney, Agent, or Firm*—Morrison & Foerster LLP

(57) ABSTRACT

A musical data performance system comprises a first changing pattern generator that generates a first changing pattern by combining a plurality of note lengths and an effect giving device that gives an effect to a tone signal in accordance with the generated first changing pattern.

20 Claims, 9 Drawing Sheets

MUSIC DATA PERFORMANCE SYSTEM AND METHOD, AND STORAGE MEDIUM STORING PROGRAM REALIZING SUCH METHOD

BACKGROUND OF THE INVENTION

A) Field of the Invention

The present invention relates to a music data performance system, and more particularly to a music data performance system for setting gate times of musical tone signals.

B) Description of the Related Art

Special effects given to musical sounds by controlling gate times of musical tone signals are known (hereinafter called slice effects). With the slice effects, on/off of reproduction of musical sounds are switched in accordance with predetermined a sound reproduction pattern.

Prestored sound reproduction patterns are directly used or edited to use modified patterns.

According to a known sound reproduction pattern forming method, musical tone signals to be given the slice effects are divided into a plurality of blocks, and a plurality of switches are prepared for each block to form a sound reproduction pattern by turning on/off these switches.

With such a conventional sound reproduction pattern forming method, however, there is a limit in the number of variations of a sound reproduction pattern capable of being formed. Since the switching operation does not match the tempo of musical sounds, it is difficult to form a sound reproduction pattern which matches the tempo.

SUMMARY OF THE INVENTION

An object of the present invention is to provide a music data performance system capable of giving musical effects rich in variations.

Another object of the present invention is to provide a music data performance system capable of easily forming a changing pattern which matches a performance tempo.

According to one aspect of the present invention, there is provided a musical data performance system comprising: a first changing pattern generator that generates a first changing pattern by combining a plurality of note lengths; and an effect giving device that gives an effect to a tone signal in accordance with the generated first changing pattern.

According to another aspect of the invention, there is provided a musical data performance system comprising: a first changing pattern generator that generates a first changing pattern by combining a plurality of note lengths; a lower limit altering device that alters a lower limit value of a parameter regarding reproduction of the changing pattern, without altering an upper limit value; and an effect giving device that gives an effect to a tone signal in accordance with the altered changing pattern.

As above, it is possible to provide a music data performance system capable of giving musical effects rich in variations, and to provide a music data performance system capable of easily forming a changing pattern which matches a performance tempo.

DETAILED DESCRIPTION OF THE PREFERRED EMBODIMENTS

Figure 1:
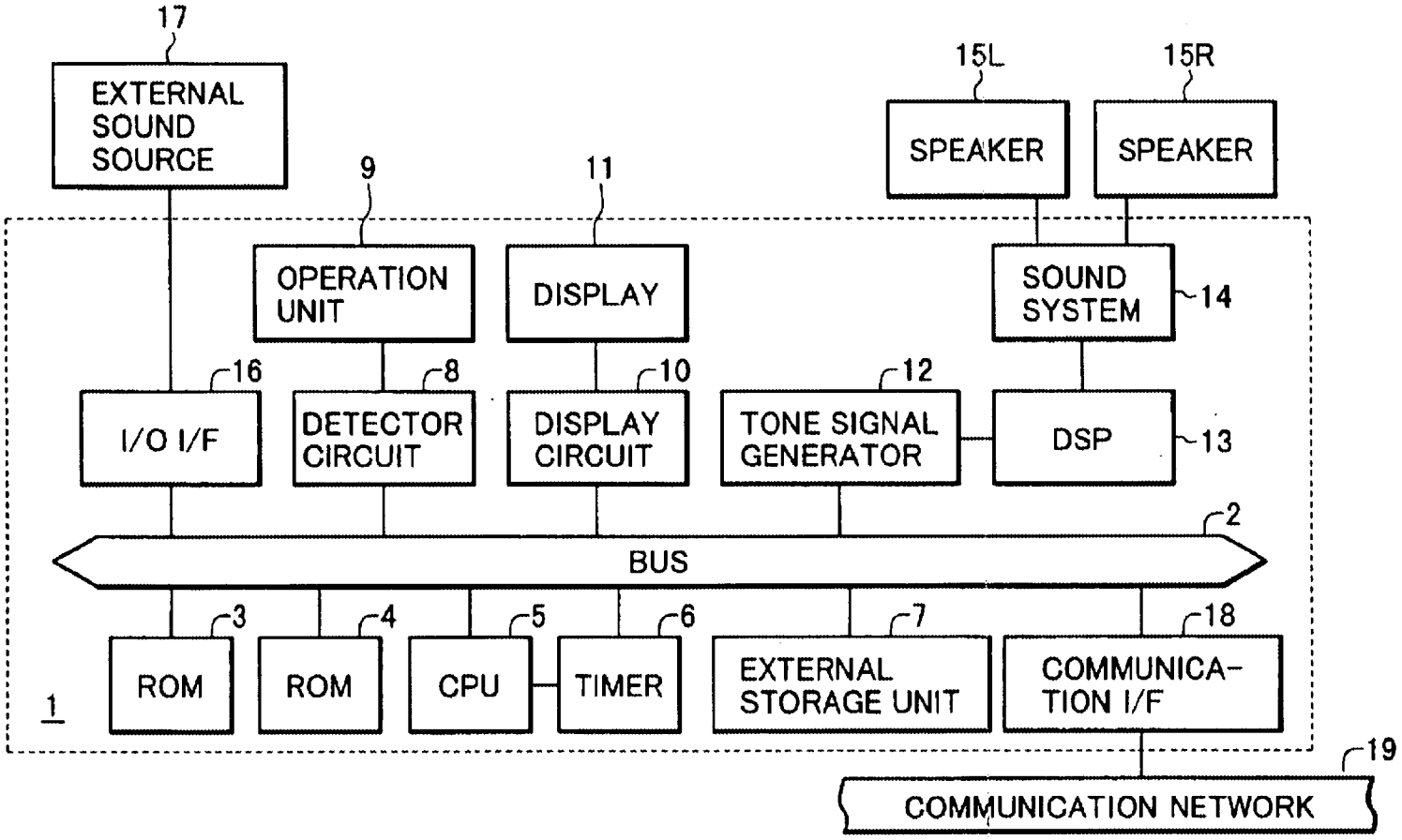
FIG. 1 is a block diagram showing a hardware structure of a music data performance system 1 according to an embodiment of the invention.

FIG. 1 is a block diagram showing the hardware structure of a music data performance system 1 according to an embodiment of the invention.

The music data performance system 1 has a bus 2, a ROM 3, a RAM 4, a CPU 5, a timer 6, an external storage unit 7, a detector circuit 8, an operation unit 9, a display circuit 10, a display 11, a tone signal generator 12, a digital signal processor (DSP) 13, a sound system 14, an input/output (I/O) interface 16, and a communication interface 18.

Connected to the bus 2 are ROM 3, RAM 4, CPU 5, timer 6, external storage unit 7, detector circuit 8, display circuit 10, tone signal generator 12, I/O interface 16 and communication interface 18.

By using the operation unit (panel operation unit) 9 connected to the detector circuit 8, a user can perform setting of an equalizer and musical effects, adjust a sound volume, input and select various parameters and preset values. For example, the operation unit 9 may be any unit capable of outputting a signal corresponding to a user input, such as a jog shuttle, a rotary encoder, a fader, a slider, a mouse, a keyboard for entering characters, a keyboard for musical performance, a joy stick, and a switch. A plurality of such input means are connected in this embodiment.

The display circuit 10 is connected to the display 11 and can display various information on the display 11.

The external storage unit 7 has an interface and is connected via the interface to the bus 2. The external storage unit 7 may be a floppy disc drive (FDD), a hard disc drive (HDD), a magneto optical disc (MO) drive, a compact disc read-only memory (CD-ROM) drive, a digital versatile disc (DVD) drive or the like.

The external storage unit 7 may store various data, a program for realizing the functions of the embodiment, and the like.

RAM 4 has flags, registers, buffers and working areas for CPU 5 for storing various data. ROM 3 can store various parameters, control programs, the program for realizing the embodiment functions, and other data. The programs and other data are not required to be stored duplicately in the external storage unit 7. CPU 5 performs calculations or controls in accordance with the control programs stored in ROM 3 or external storage unit 7.

The timer 6 is connected to CPU 5 and the bus 2, and supplies CPU 5 with a main clock signal, an interrupt timing and the like.

The I/O interface 16 is used for connection to an external sound source 17, other musical instruments, electronic musical instruments, audio apparatuses, computers or the like, and can transmit/receive at least musical performance data. A MIDI interface may be used as the I/O interface 16. The MIDI interface is not limited only to a dedicated MIDI interface, but it may be other general interfaces such as RS-232C, universal serial bus (USB) and IEEE1394. In this case, data other than MIDI message data may be transmitted/received at the same time.

The external sound source 17 is an audio apparatus, an electronic musical instrument or the like to be connected to the I/O interface 16. The type of an electronic musical instrument is not limited only to a keyed instrument, but other types may also be used such as a stringed instrument, a wind instrument and a percussion instrument. The external tone generator is not limited only to the type that the components thereof such as a tone signal generator and an automatic performance apparatus are all built in one integrated body, but these components may be discrete and interconnected by communication means such as MIDI and various networks. The external sound source 17 may be used as an operation unit for entering various settings and information.

The tone signal generator 12 generates tone signals in accordance with supplied MIDI signals or the like, and supplies the generated tone signals to the sound system 14 via DSP 13.

DSP 13 performs various processes for a tone signal supplied from the tone signal generator 12.

The sound system 14 includes a D/A converter, and converts supplied digital tone signals into analog tone signals which are sent to right and left two-channel speakers 15R and 15L to produce sounds.

The tone signal generator 12 may be of any type, such as a waveform memory type, an FM type, a physical model type, a harmonics synthesis type, a formant synthesis type, and an analog synthesizer type having a voltage controlled oscillator (VCO)+a voltage controlled filter (V/CF)+a voltage controlled amplifier (VCA).

The tone signal generator 12 is not limited only to those made of hardware, but may be realized by a digital signal processor (DSP) and a microprogram, by a CPU and a software program, or by a sound card.

One tone generator may be used time divisionally to form a plurality of sound producing channels, or a plurality of tone signal generators may be used to form a plurality of sound producing channels by using one tone signal generator per one sound producing channel.

The control programs, program realizing the embodiment functions and the like may be stored in a hard disc (HDD) of the external storage unit 7. By reading the control programs and the like from the hard disc to RAM 4, CPU 5 can perform operations similar to those when the control programs and the like are stored in ROM 3. In this case, addition, version-up and the like of the control programs and the like can be made easy.

The control programs, program for realizing the embodiment functions and the like may be stored in a CD-ROM. The control programs, program for realizing the embodiment functions and the like may be copied from CD-ROM to the hard disc. In this case, addition, version-up and the like of the control programs and the like can be made easy.

The communication interface 18 is connectable to the communication network 19 such as a local area network (LAN), the Internet, and a telephone line. The music data performance system may be connected to a server via the communication network 19 to download the control programs, program for realizing the embodiment functions, musical tone signal data and the like from the server into the external storage unit 7 such as HDD and into RAM 4.

Figure 2:
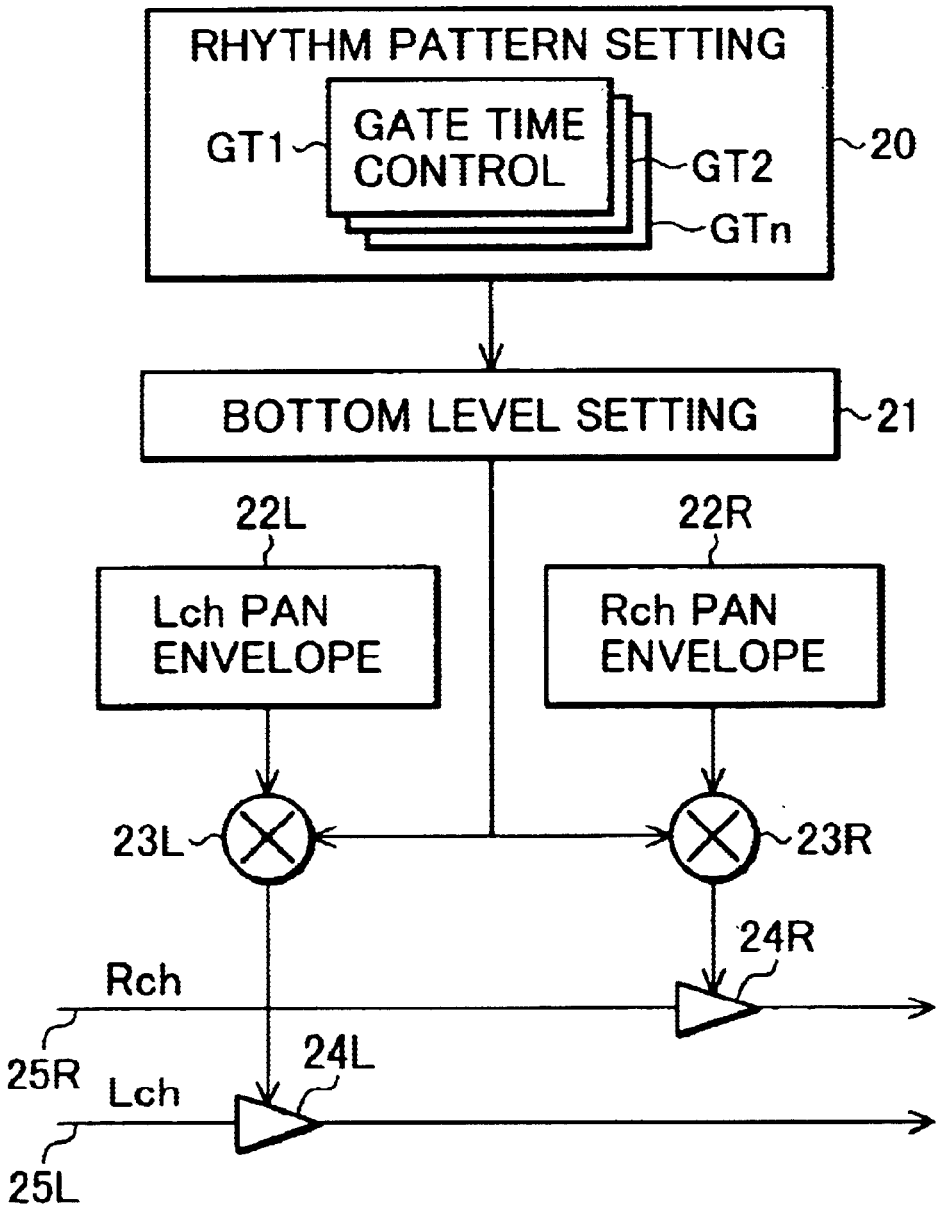
FIG. 2 is a block diagram showing the function of the music data performance system 1 of the embodiment.

FIG. 2 is a block diagram showing the functions of the music data performance system 1 of the embodiment.

The musical data performance system 1 is constituted of, for example, a rhythm pattern setting unit 20, a bottom level setting unit 21, a left channel (Lch) PAN envelope setting unit 22L, a right channel (Rch) PAN envelope setting unit 22R, a left channel multiplier 23L, a right channel multiplier 23R, a left channel amplifier 24L, a right channel amplifier 24R, left channel tone signal line 25L and a right channel tone signal line 25R.

The rhythm pattern setting unit 20 has a plurality of gate time controllers GT1 to GTn capable of changing a gate time in accordance with the tempo or the like of musical tone signals. As will be later detailed, the rhythm pattern setting unit 20 sets a cutting pattern to be used for time sequentially controlling the volume of an input tone signal.

Each gate time controller GT may be assigned a particular note length such as a sixteenth note, an eighth note and a quarter note. The rhythm pattern setting unit 20 generates various cutting patterns by combining a plurality of gate time controllers corresponding to respective note lengths.

A cutting pattern is a combination of on (1) and off (0) of reproduction of a tone signal. In this embodiment, the on-state of reproduction is represented by a numerical value "1", and the off-state is represented by a numerical value "0". The on-state of reproduction means that the volume of an input tone signal is not lowered, and the off-state of reproduction means that the volume of an input tone signal is lowered to a minimum value (e.g., zero volume).

The bottom level setting unit 21 can change the value of an off-state section of a cutting pattern generated by the rhythm pattern setting unit 20, continuously in the range from 0 to 1. The bottom level of the reproduction pattern can therefore be set freely. Namely, not only simply changing the volume either to the on-state or off-state, the volume is changed as desired, for example, between the normal volume and a 25% volume of the normal volume.

The Lch PAN envelope setting unit 22L and Rch PAN envelope setting unit 22R set the Lch and Rch PAN envelopes, respective, in accordance with a static pattern set in the manner to be later described.

The left channel multiplier 23L and right channel multiplier 23R synthesize the cutting pattern generated by the rhythm pattern setting unit 20 and edited by the bottom level setting unit 21 and the right and left channel PAN envelopes to generate right and left channel reproduction patterns.

The right channel amplifier 24R and left channel amplifier 24L control the volumes of tone signals input to the right and left channel tone signal lines 25R and 25L, in accordance with the right and left channel reproduction patterns.

Figure 3:
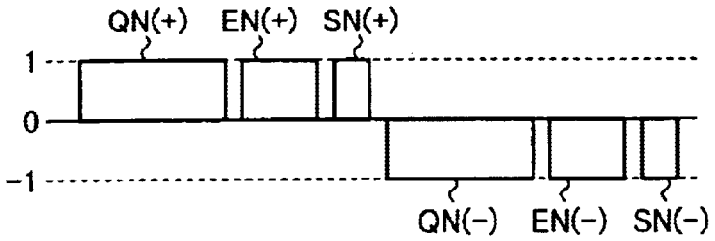
FIG. 3 is a diagram showing the types of note patterns to be used when a rhythm pattern setting unit 20 shown in FIG. 2 sets a cutting pattern.

FIG. 3 is a diagram showing the types of note patterns to be used when the rhythm pattern setting unit 20 shown in FIG. 2 sets the cutting pattern.

In this embodiment, a note pattern QN for a quarter note, a note pattern EN for an eighth note and a note pattern SN for a sixteenth note are prepared. Each note pattern corresponds to one of the gate time controllers GT shown in FIG. 2.

The note pattern QN for a quarter note, a note pattern EN for an eighth note and a note pattern SN for a sixteenth note each have a value (+1) and a value (−1). Therefore, six types of note patterns exist. A user combines these note patterns to form a cutting pattern.

If two or more note patterns are combined and they are superposed, the superposed section has a value obtained by adding the superposed note values, in the range from the maximum value of 1 to the minimum value of −1. For example, if the note pattern having the value (+1) and the note pattern having the value (−1) are superposed, the value of the superposed section is (0). If the note pattern having the value (+1) and the note pattern having the value (+1) are superposed, the value of the superposed section is (+1) because the maximum value is limited to +1. Similarly, if the note pattern having the value (−1) and the note pattern having the value (−1) are superposed, the value of the superposed section is (−1) because the minimum value is limited to −1.

The note pattern is not limited only to the three note lengths, but any other note length may be used such as a thirty-second note length, a whole note length and a half note length. The number of note lengths to be used is not limited only to three, but more note lengths may also be used.

Figure 4:
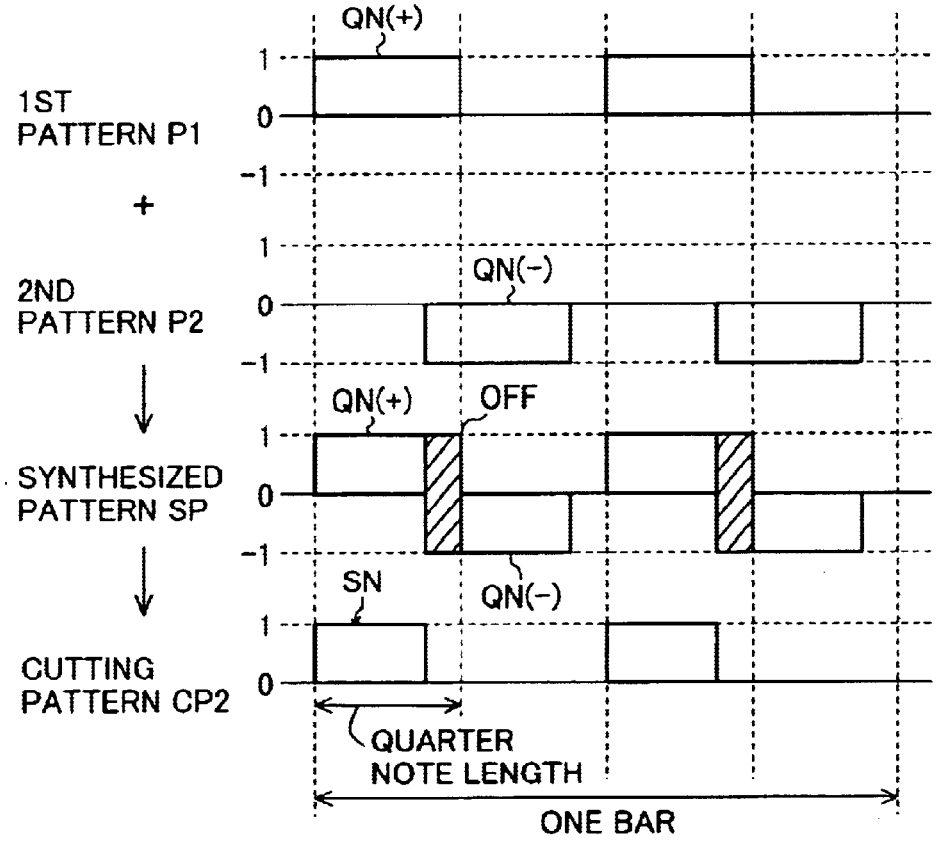
FIG. 4 is a conceptual diagram illustrating a first example of a process of forming a cutting pattern CP to be executed by the rhythm pattern setting unit 20 shown in FIG. 2.

FIG. 4 is a conceptual diagram showing a first example of a process of forming a cutting pattern CP to be executed by the rhythm pattern setting unit 20 shown in FIG. 2. In this embodiment, a cutting pattern of a single bar is formed. The cutting pattern of a signal bar once formed may be used a plurality of times.

In this example, as shown in FIG. 4, a note pattern QN(+) of a quarter note length is applied to the top beat (first beat) of the bar and the same note pattern QN(+) is applied to the third beat to form a first pattern P1.

Next, a note pattern EN(+) of an eighth note length is applied to the second beat of the bar and the same note pattern EN(+) is applied to the fourth beat to form a second pattern P2.

Next, the first and second pattern P1 and P2 are added together to form a synthesized pattern SP or cutting pattern CP1 having the synthesized note length SN. In this example, the synthesized note length SN is a dotted quarter note length.

By combining a plurality type of note lengths, a note pattern having a new note length can be formed.

Figure 5:
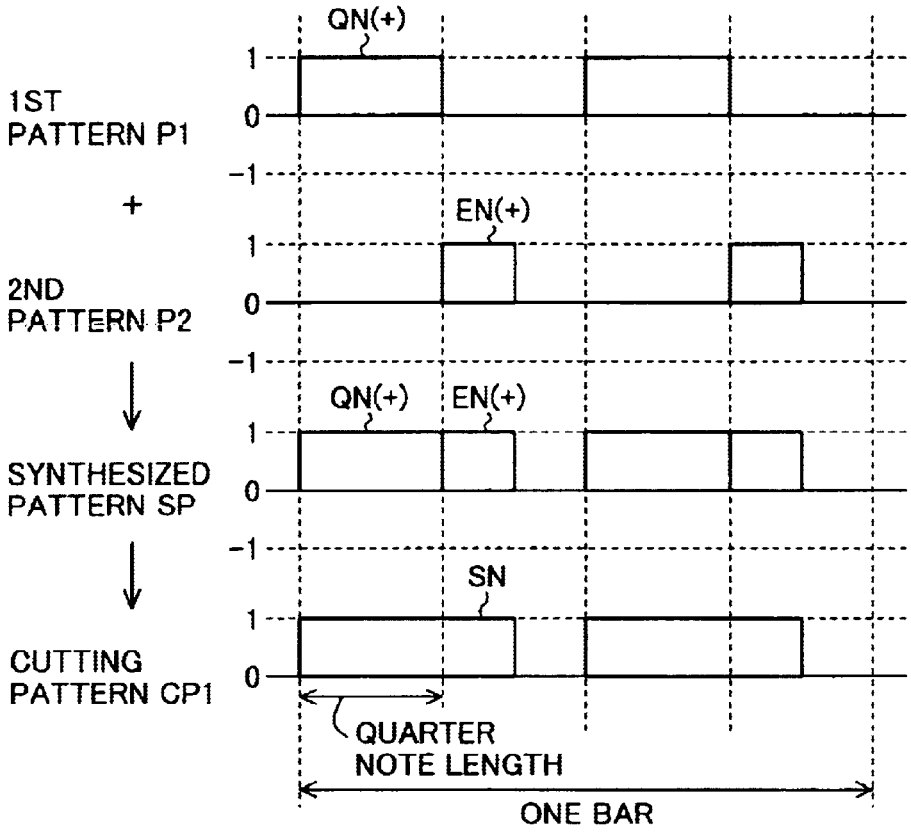
FIG. 5 is a conceptual diagram illustrating a second example of a process of forming a cutting pattern CP to be executed by the rhythm pattern setting unit 20 shown in FIG. 2.

FIG. 5 is a conceptual diagram showing a second example of a process of forming a cutting pattern CP to be executed by the rhythm pattern setting unit 20 shown in FIG. 2.

In this example, as shown in FIG. 5, a note pattern QN(+) of a quarter note length is applied to the top beat (first beat) of the bar and the same note pattern QN(+) is applied to the third beat to form a first pattern P1.

Next, a note pattern EN(−) of an eighth note length is applied to the weak part of the first beat (1.5 beat) of the bar and a note pattern EN(+) is applied to the weak part of the third beat (3.5 beat) and the fourth beat to form a second pattern P2.

Next, a note pattern SN(−) of a sixteenth note length is applied to the 2.75 beat of the bar.

Next, the first to third patterns P1 to P3 are added together to form a synthesized pattern SP. The hatched area shown in FIG. 5 has an off-state (0) because the note pattern (+) and note pattern (−) are superposed. In this manner, a cutting pattern CP2 is formed. A synthesized note length SN1 is an eighth note length, and a synthesized note length SN2 is a dotted eighth note length, and a synthesized note length SN3 is a quarter note length.

The cutting pattern CP is formed in the above-described manner. A note length pattern is input by a user by using, for example, the operation unit (switch) 9 shown in FIG. 1. In this embodiment, a switch corresponding to each note length and switches for selecting values of (+) and (−) are provided.

Switches corresponding to note lengths are not required to be prepared for all note lengths, but one switch may be used to select a note length.

In this embodiment, the first to third patterns P1 to P3 are manually input. Of these patterns, at least one pattern may be selected from prestored patterns.

These patterns may use only the note lengths in the MIDI data of a general music program or the MIDI data supplied from an electronic musical instrument or the like. Namely, the cutting pattern is formed by using note lengths so that any data related to note lengths can be used for forming cutting pattern data.

In this manner, the cutting pattern may be formed, for example, by using sounds of a drum or by using musical performance of any other musical instruments.

Figure 6:
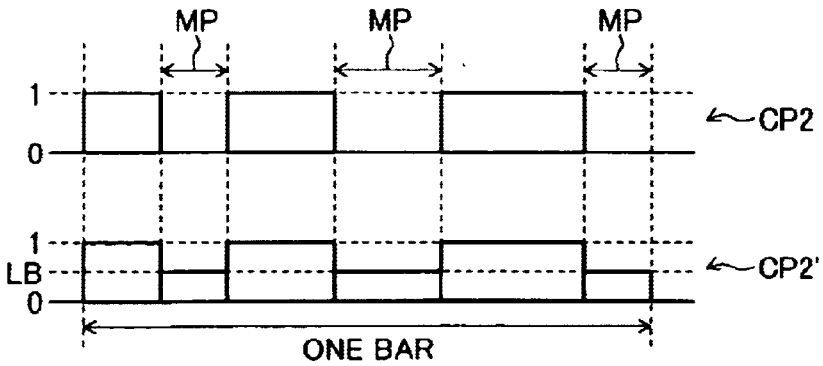
FIG. 6 is a conceptual diagram illustrating an example of a process of editing the cutting pattern CP2 shown in FIG. 5 to be executed by a bottom level setting unit 21 shown in FIG. 5.

FIG. 6 is a conceptual diagram showing an example of a process of editing the cutting pattern CP2 shown in FIG. 5 to be executed by the bottom level setting unit 21 shown in FIG. 2.

A cutting pattern CP2' is formed by setting the mute part MP in the value (0) section of the cutting pattern CP2 formed by the rhythm pattern setting unit 20, to the bottom level LB to be set by a user.

The bottom level LB is set to a value from 0 to 1. Namely, the bottom level LB is set to a value satisfying $0 \leqq LB \leqq 1$.

The bottom level LB may be designated by a decibel value or a ratio of the bottom level LB to the maximum level.

Figure 7:
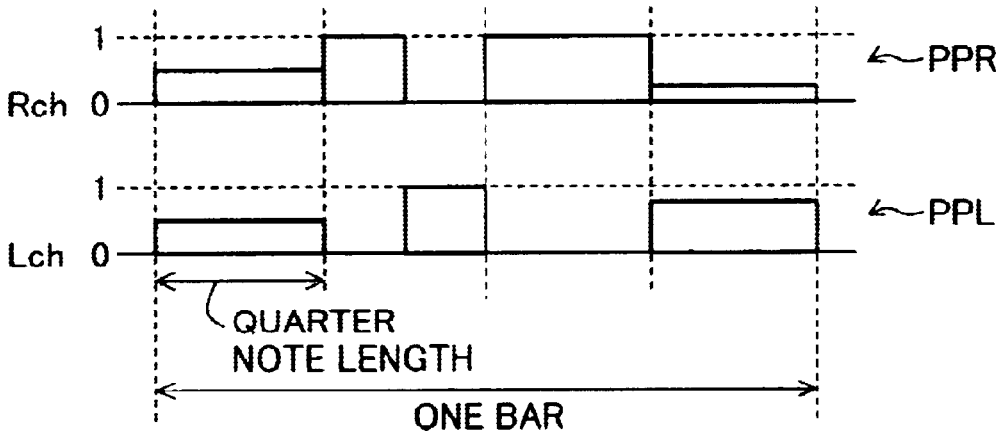
FIG. 7 is a conceptual diagram showing right and left channel PAN envelopes PPR and PPL formed by right and left channel PAN envelope setting units 22R and 22L shown in FIG. 2.

FIG. 7 is a conceptual diagram showing right and left channel PAN envelopes PPR and PPL formed by the right and left channel envelope setting units 22R and 22L.

Similar to forming the cutting pattern CP, a PAN envelope PP is formed by synthesizing note patterns corresponding to note lengths. In this embodiment, by using the switch or the like used when the cutting pattern CP is formed, a user selects a note length, and by using another PAN distributing operation unit 9, PAN is distributed. The PAN distributing operation unit 9 may be a rotary encoder.

The PAN envelope PP indicates a time sequential change in the balance of right and left volumes. The total output volume of right and left volumes is "1". Namely, if the left channel volume output is "0.5", the right channel volume output is also "0.5". If the left channel volume output is "0.25", the right channel volume output is "0.75".

Figure 8:
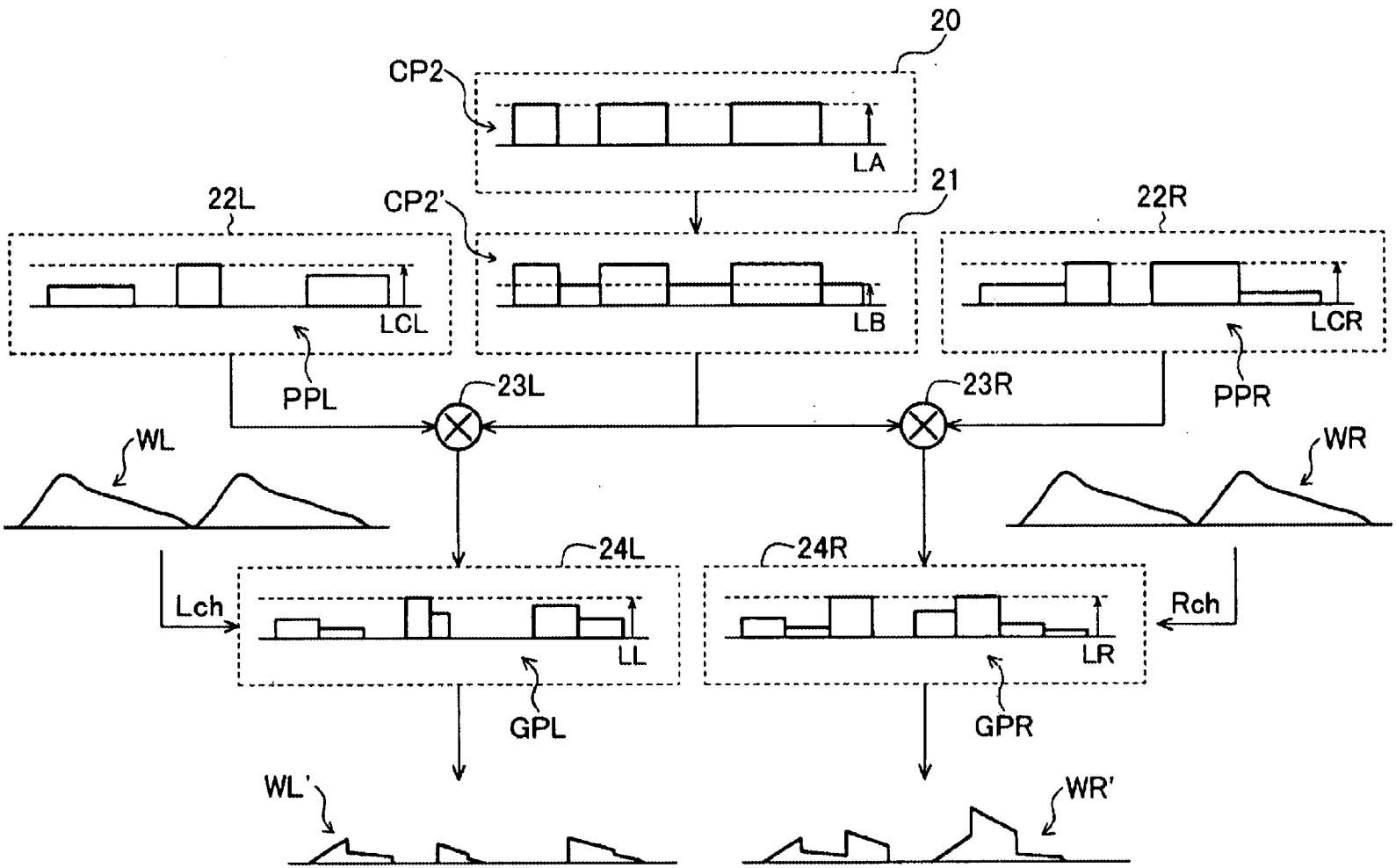
FIG. 8 is a block diagram showing an example of a process of editing a musical tone signal waveform to be executed by the musical data performance system 1 of the embodiment.

FIG. 8 is a block diagram showing an example of a process of editing musical tone signal waveforms to be executed by the music data performance system 1 of the embodiment. Elements having similar functions shown in FIGS. 2, 4, 5 and 6 are represented by identical reference symbols.

First, the rhythm pattern setting unit 20 forms a cutting pattern CP2 having a highest reproduction level LA. Thereafter, the bottom level setting unit 21 changes the section of the reproduction level "0" of the cutting pattern CP2 to the reproduction level LB to form a cutting pattern CP2'.

The cutting pattern CP2' is branched to two lines and sent to the right and left channel multipliers 23R and 23L.

The Lch PAN envelope setting unit 22L forms a PAN envelope PPL at the highest reproduction level LCL and sends it to the left channel multiplier 23L.

The Rch PAN envelope setting unit 22R forms a PAN envelope PPR at the highest reproduction level LCR and sends it to the right channel multiplier 23R.

The left channel multiplier 23L synthesizes the supplied cutting pattern CP2' and PAN envelope PPL to generate the reproduction pattern GPL at the highest reproduction level LL and send it to the left channel amplifier 24L.

The right channel multiplier 23R synthesizes the supplied cutting pattern CP2' and PAN envelope PPR to generate the reproduction pattern GPR at the highest reproduction level LL and send it to the right channel amplifier 24R.

In the above-described manner, the right and left channel reproduction patterns GPR and GPL are formed from the cutting pattern CP2, as shown in FIG. 8. The reproduction patterns GP are envelopes for controlling the volumes of the right and left channel amplifiers 24.

The left channel amplifier 24L changes the reproduction level of an input waveform WL in accordance with the section of the reproduction pattern GPL corresponding to the current clock number of the input waveform WL.

The right channel amplifier 24R changes the reproduction level of an input waveform WR in accordance with the section of the reproduction pattern GPR corresponding to the current clock number of the input waveform WR.

Figure 9:
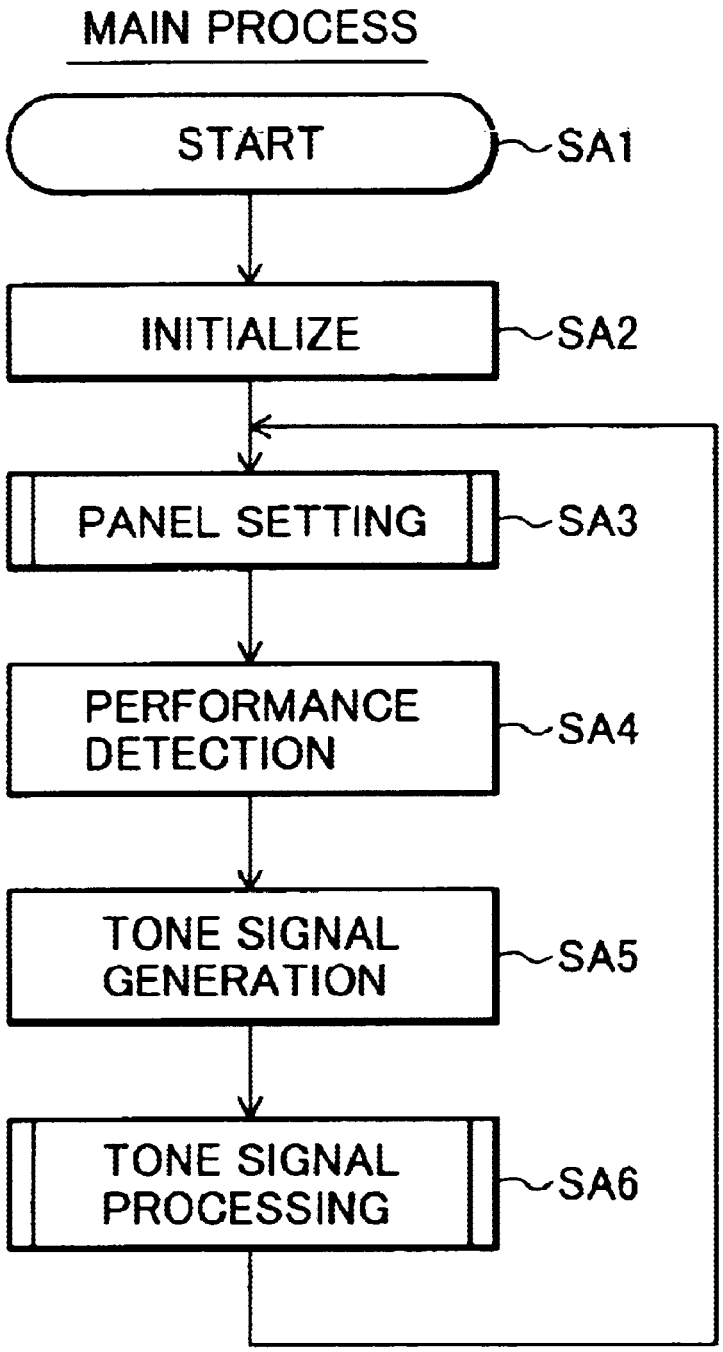
FIG. 9 is a flow chart illustrating a main process to be executed by CPU 5 shown in FIG. 1.

FIG. 9 is a flow chart illustrating the main process to be executed by CPU 5 shown in FIG. 1 according to the embodiment of the invention.

The main process starts at Step SA1. Thereafter, the flow advances to next Step SA2.

At Step SA2, various flags are initialized to display an initial window on the display to thereafter advance to next Step SA3.

At Step SA3, a panel setting process is executed. The panel setting process will be later described. Thereafter, the process advances to next Step SA4.

At Step SA4 a performance signal input to the I/O interface 16 shown in FIG. 1 is detected. The performance signal is generated when a user plays a musical performance by using the external sound source 17, an electronic musical instrument or the like. At this Step SA4, instead of a performance signal supplied by the user, prestored performance data or a tone signal from a CD-ROM may be input. In this case, the performance data or tone signal is detected. After the performance signal is detected, the flow advances to next Step SA5.

At Step SA5, a tone signal is generated from the detected performance signal, for example, by using the tone signal generator 12 shown in FIG. 1. If a tone signal is input at Step SA4, Step SA5 may be skipped. Thereafter, the flow advances to next Step SA6.

At Step SA6 the generated tone signal is processed. The details of the tone signal processing will be later given. After the tone signal processing, the flow returns to Step SA3.

Figure 10:
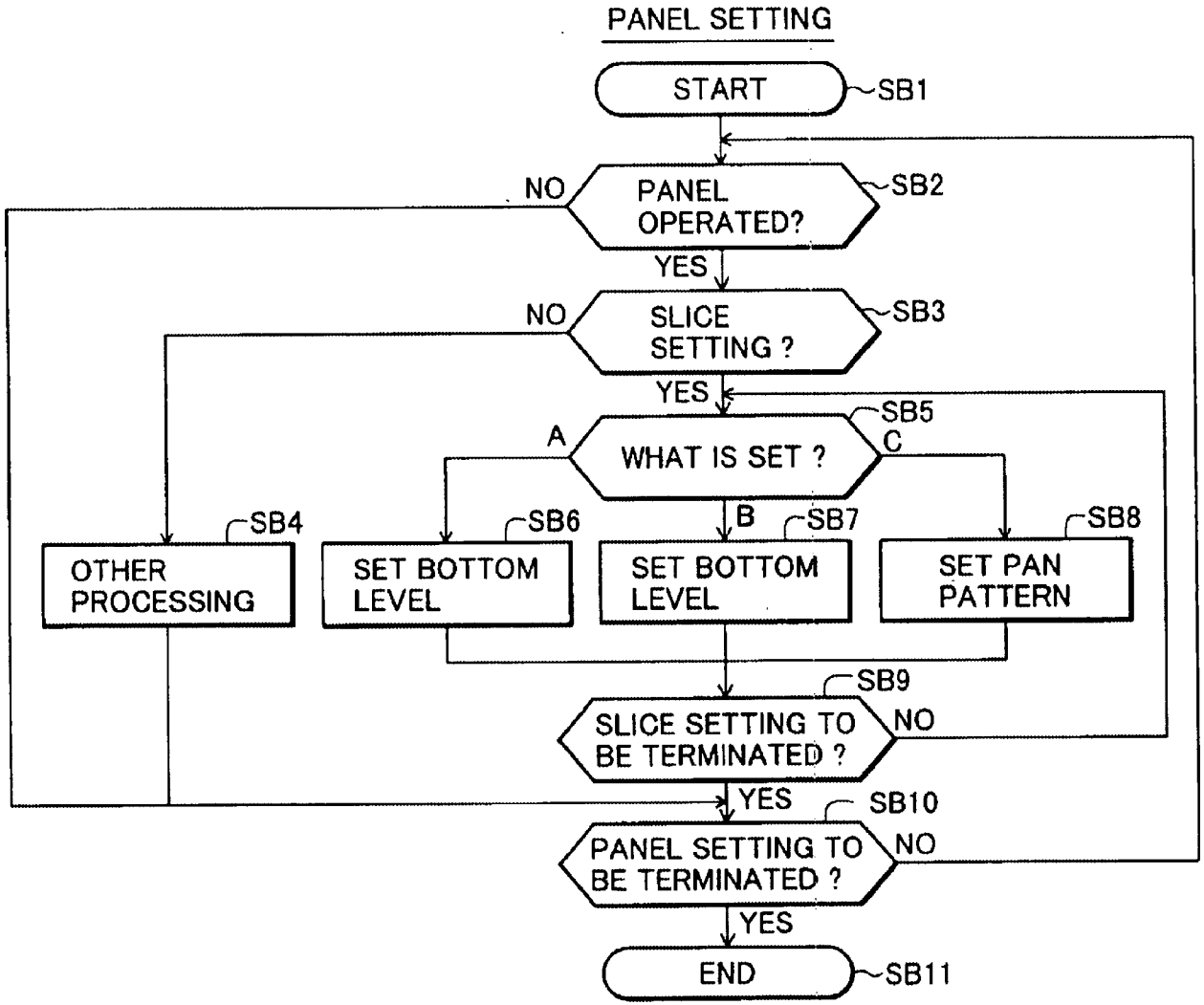
FIG. 10 is a flow chart illustrating a panel setting process to be executed at Step SA3 shown in FIG. 9.

FIG. 10 is a flow chart illustrating the panel setting process at Step SA3 shown in FIG. 9.

In this embodiment, a plurality of operation units 9 (FIG. 1) are provided in order for a user to enter various parameters. The plurality of these effect setting operation units are hereinafter called a panel.

At Step SB1 the panel setting process starts to thereafter advance to next Step SB2.

At Step SB2 it is detected whether the user operates the panel. If the user operates the panel, the flow advances to next Step S83 indicated by a YES arrow. If the user does not operate the panel, the flow skips to Step SB10 indicated by a NO arrow.

At Step SB3 it is judged whether the operation unit 9 operated at Step SB2 is related to the slice setting. If it is judged that the operation unit 9 is related to the slice setting, the flow advances to Step SB5 indicated by a YES arrow. If it is judged that the operation unit 9 is not related to the slice setting, the flow branches to Step SB4.

At Step SB4, settings other than the slice effect settings are performed. Other settings include on/off of the slice effects, storing/reading the setting of the slice effects, reading automatic performance information, reproduction of tone signal information, setting of a sound source, and the like. After the other setting is performed, the flow advances to Step SB10.

At Step SB5 it is judged from the user operation of the operation unit 9 what is set among the slice effect settings. If it is judged that the cutting pattern CP is to be set, the flow advances to Step SB6 indicated by an arrow A. If it is judged that the bottom level LB is to be set, the flow advances to Step SB7 indicated by an arrow B. If it is judged that the PAN envelope is to be set, the flow advances to Step SB8 indicated by an arrow C.

At Step SB6 the cutting pattern is set. As described with reference to FIGS. 4 and 5, in setting the cutting pattern CP, the user operates operation units corresponding to note lengths to form a pattern of note lengths corresponding to the operated operation units, and a plurality of patterns are synthesized. Thereafter, the cutting pattern CP formed by the user is stored in RAM 4, external storage unit 7 or the like to thereafter advance to Step SB9.

At Step SB7 the bottom level LB is set. As described with reference to FIG. 6, in setting the bottom level LB, the level of the section of the volume "0" of the cutting pattern CP is changed to the value designated by the user. Thereafter, the value input by the user is stored in RAM 4, external storage unit 7 or the like to thereafter advance to Step SB9.

At Step SB8 the PAN envelope PP is set. As descried with reference to FIG. 7, in setting the PAN envelope PP, the user sets a volume ratio between the right and left channels. Thereafter, the value input by the user is stored in RAM 4, external storage unit 7 or the like to thereafter advance to Step SB9.

At Step SB9, the user is inquired whether the slice effect settings are to be terminated. If the slice effect settings are to be terminated, the flow advances to Step SB10 indicated by a YES arrow. If the slice effect settings are not terminated, the flow returns to Step SB5 indicated by a NO arrow.

At Step SB10, the user is inquired whether the panel setting process is to be terminated. If the panel setting process is to be terminated, the flow advances to Step SB11 indicated by a YES arrow. If the panel setting process is not terminated, the flow returns to Step SB2 indicated by a NO arrow.

At Step SB11, the panel setting process is terminated.

Figure 11:
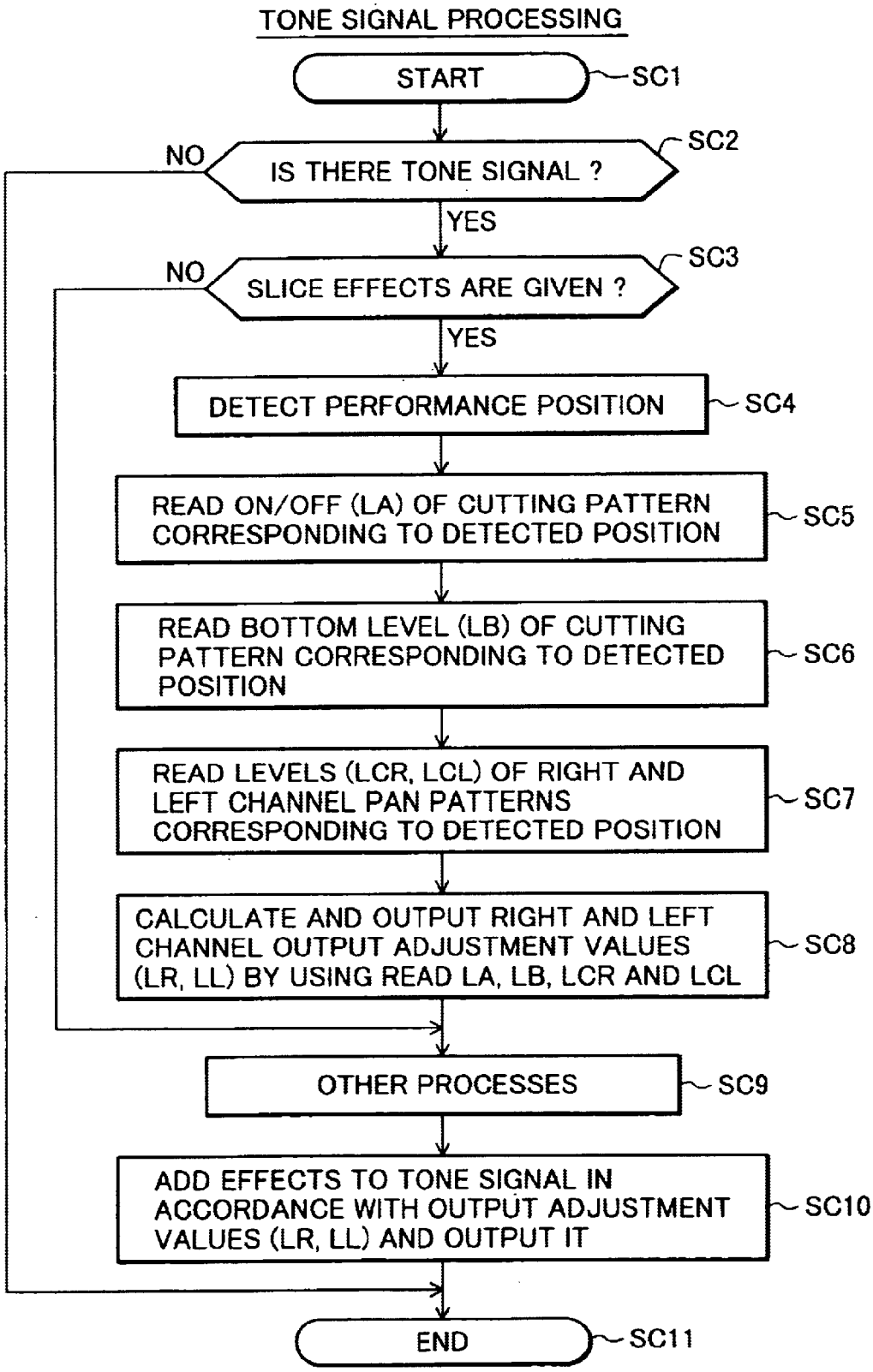
FIG. 11 is a flow chart illustrating panel musical tone signal processing to be executed at Step SA5 shown in FIG. 9.

FIG. 11 is a flow chart illustrating the panel tone signal processing at Step SA5 shown in FIG. 9.

At Step SC1 the tone signal processing starts. Thereafter, the flow advances to Step SC2.

At Step SC2 it is judged whether there is a tone signal to be processed. If there is a tone signal, the flow advances to Step SC3 indicated by a YES arrow. If there is no tone signal, the flow skips to Step SC11 indicated by a NO arrow.

At Step SC3, it is judged whether the slice effects are given. If the slice effects are to be given, the flow advances to Step SC4 indicated by a YES arrow. If the slice effects are not given, the flow skips to Step SC9 indicated by a NO arrow.

At Step SC4 the current performance position is detected from the clock supplied from the timer 6 shown in FIG. 2. Thereafter, the flow advances to Step SC5.

At Step SC5, the level LA (on or off) of the cutting pattern corresponding to the performance position detected at Step SC4 is read from the cutting pattern CP stored in RAM 4 or the like. Thereafter, the flow advances to Step SC6.

At Step SC6, the bottom level LB corresponding to the performance position detected at Step SC4 is read from the bottom level LB stored in RAM 4 or the like. Thereafter, the flow advances to Step SC7.

At Step SC7, the right and left levels LCR and LCL of the PAN envelopes PP corresponding to the performance position detected at Step SC4 are read from the PAN envelopes stored in RAM 4 or the like. Thereafter, the flow advances to Step SC8.

At Step SC8, the level LA, bottom level LB and PAN levels LCR and LCL read at Steps SC5 to SC7 are calculated in the manner described with reference to FIG. 8, to generate the right and left channel output adjustments values (levels LL and LR of the reproduction patterns GPL and GPR).

Step SC9 is executed for the case that the slice effects are not given at Step SC2. At Step SC9 other processes are executed to thereafter advance to Step SC10. The other processes are processes regarding the performance signal processing, and include processes other than the slice effects, such as chorus, delay and reverberation.

At Step SC10, the effects are given to the tone signal and output, in accordance with the output adjustment values (levels LL and LR of reproduction patterns GPL and GPR) for slicing and the other effects processed at Step SC9. Thereafter, the flow advances to Step SC11 to terminate the tone signal processing.

The slice effects are realized by controlling the volumes of the tone signal in accordance with the output adjustment values output at Step SC9. By controlling the volumes, the slice effects can be given irrespective of the type of a tone signal, e.g., waveform data and automatic performance data such as MIDI data.

According to the embodiment, since the reproduction pattern can be formed by using note lengths, the reproduction pattern can be set with ease in the unit of a bar.

Since the reproduction pattern can be formed by using note lengths, the musical performance can be easily synchronized with the tempo of a music program.

It is easy to form a PAN envelope synchronized with a tempo easily.

In the embodiment, although a combination of the cutting pattern and PAN envelope is used, the combination is not limited only thereto. The reproduction pattern may be formed by using a combination of any reproduction parameters of music sounds so long as they can change the reproduction state of music sounds. For example, instead of the cutting pattern and PAN envelope, pitch bend, modulation, velocity and the like may be used. The reproduction state of music sounds may also be changed by forming a changing pattern using various echo effects, a modulation process and the like.

For example, in forming a changing pattern of a pitch bend, the shift amount of a pitch is designated instead of the volume (reproduction level).

The combination is not limited only to two patterns but three or more patterns may be used to form a reproduction pattern.

In this embodiment, although right and left two channels are used, right and left and up and down four channels may also be used as input channels. Five or more input channels are easily realized by increasing the number of PAN envelopes and the like.

In this embodiment, the same right and left cutting patterns and different right and left PAN envelopes are synthesized. Different right and left cutting patterns may also be used.

In this embodiment, although the tone signal information has been described as waveform data, other types of data may also be used. For example, automatic performance information such as MIDI data may be edited without changing it into waveform data. In this case, editing is performed by using the gate time of the MIDI data and a reproduction pattern for forming a PAN envelope.

In this embodiment, a reproduction pattern of one bar is used repetitively. The embodiment is not limited only thereto. For example, a reproduction pattern of two or more bars may be formed and used repetitively, or a reproduction pattern of one music program may be formed.

The embodiment may be realized by a commercially available general computer installed with the computer program and the like realizing the functions of the embodiment.

In such a case, the computer program and the like realizing the embodiment functions may be stored in a computer readable storage medium such as a CD-ROM and a floppy disc and supplied to users.

If a general purpose computer or personal computer is connected to a communication network such as a LAN, the Internet and a telephone line, the computer program and various data may be supplied to the general purpose computer or personal computer via the communication network.

The present invention has been described in connection with the preferred embodiments. The invention is not limited only to the above embodiments. It is apparent that various modifications, improvements, combinations, and the like can be made by those skilled in the art.

What is claimed is:

1. A musical data performance system comprising:

an operating device for providing a plurality of selectable note lengths;

a first changing pattern generator that generates a first changing pattern by combining a first selected plurality of note lengths; and an effect giving device that gives an effect to a tone signal in accordance with the generated first changing pattern.

2. A music data performance system according to claim 1, further comprising:

a plurality of sound reproduction channels;

a second changing pattern generator that generates different second changing patterns for at least two different channels of said plurality of sound reproduction channels, by combining a second selected plurality of note lengths;

a third changing pattern generator that generates third changing patterns by synthesizing the first changing pattern and the second changing patterns; and wherein the effect giving device gives an effect to a tone signal in accordance with the generated third changing patterns.

3. A music data performance system according to claim 2, wherein the changing patterns can be set by a measure as a unit and used repeatedly.

4. A music data performance system according to claim 2, wherein the second changing patterns are for a left-channel and a right-channel of sound reproduction channels.

5. A music data performance system according to claim 2, wherein the changing patterns are sound reproduction patterns.

6. A music data performance system according to claim 5, wherein said first selected plurality of note lengths are positive note lengths and negative note lengths, and said first selected plurality of note lengths at a same timing are added.

7. A music data performance system according to claim 5, wherein levels of said first selected plurality of note lengths are in a range between a maximum sound reproduction level and a negative of the maximum sound reproduction level.

8. A musical data performance system comprising:

an operating device for providing a plurality of selectable note lengths;

a first changing pattern generator that generates a first changing pattern by combining a first selected plurality of note lengths;

a lower limit altering device that alters a lower limit value of a parameter regarding reproduction of the changing pattern, without altering an upper limit value; and an effect giving device that gives an effect to a tone signal in accordance with the altered changing pattern.

9. A music data performance system according to claim 8, further comprising:

a plurality of sound reproduction channels;

a lower limit altering device that alters a lower limit value of a parameter regarding reproduction of the first changing pattern, without altering an upper limit value;

a second changing pattern generator that generates different second changing patterns for at least two different channels of said plurality of sound reproduction channels, by combining a second selected plurality of note lengths;

a third changing pattern generator that generates third changing patterns by synthesizing the first changing pattern and the second changing patterns; and wherein the effect giving device gives an effect to a tone signal in accordance with the generated third changing patterns.

10. A music data performance system according to claim 9, wherein the changing patterns can be set by a measure as a unit and used repeatedly.

11. A music data performance system according to claim 9, wherein the second changing patterns are for a left-channel and a right-channel of sound reproduction channels.

12. A music data performance system according to claim 9, wherein the changing patterns are sound reproduction patterns.

13. A music data performance system according to claim 12, wherein said first selected plurality of note lengths are positive note lengths and negative note lengths, and said first selected plurality of note lengths at a same timing are added.

14. A music data performance system according to claim 12, wherein levels of said first selected plurality of note lengths are in a range between a maximum sound reproduction level and a negative of the maximum sound reproduction level.

15. A music data performance system according to claim 12, wherein said lower limit of said first selected plurality of note lengths can be set in a range between 0 (no sound) and 1 (maximum sound).

16. A music data performance system according to claim 12, wherein middle levels of said first selected plurality of note lengths are changed in accordance with a change in said lower limit.

17. A musical data performance method comprising the steps of:

providing a plurality of selectable note lengths;

generating a first changing pattern by combining a selected plurality of note lengths; and giving an effect to a tone signal in accordance with the generated first changing pattern.

18. A musical data performance method comprising the steps of:

providing a plurality of selectable note lengths;

generating a first changing pattern by combining a selected plurality of note lengths;

altering a lower limit value of a parameter regarding reproduction of the changing pattern, without altering an upper limit value; and giving an effect to a tone signal in accordance with the altered changing pattern.

19. A program that a computer executes to realize a music data performance process, comprising the instructions of:

providing a plurality of selectable note lengths;

generating a first changing pattern by combining a selected plurality of note lengths; and giving an effect to a tone signal in accordance with the generated first changing pattern.

20. A program that a computer executes to realize a music data performance process, comprising the instructions of:

providing a plurality of selectable note lengths;

generating a first changing pattern by combining a selected plurality of note lengths;

altering a lower limit value of a parameter regarding reproduction of the changing pattern, without altering an upper limit value; and giving an effect to a tone signal in accordance with the altered changing pattern.

* * * * *